US008578925B2

(12) United States Patent
Kelley et al.

(10) Patent No.: US 8,578,925 B2
(45) Date of Patent: Nov. 12, 2013

(54) OVEN DOOR ASSEMBLY INCORPORATING OVERLAY MEMBER

(75) Inventors: Joseph E. Kelley, Cleveland, TN (US); Russell L. Simms, II, Cleveland, TN (US); Gregory S. Wade, Ooltewah, TN (US)

(73) Assignee: Whirlpool Corporation, Benton Harbor, MI (US)

( * ) Notice: Subject to any disclaimer, the term of this patent is extended or adjusted under 35 U.S.C. 154(b) by 1455 days.

(21) Appl. No.: 11/189,883

(22) Filed: Jul. 27, 2005

(65) Prior Publication Data

US 2007/0023029 A1 Feb. 1, 2007

(51) Int. Cl.
*F23M 7/04* (2006.01)

(52) U.S. Cl.
USPC ..... 126/190; 126/198; 126/200; 312/204; 110/173 R

(58) Field of Classification Search
USPC ..... 126/198, 200, 42, 190, 201; 110/173 R, 110/174, 173 B, 180, 181, 182
See application file for complete search history.

(56) References Cited

U.S. PATENT DOCUMENTS

| | | | | | |
|---|---|---|---|---|---|
| 1,127,021 | A | * | 2/1915 | Klett | 219/407 |
| 2,193,469 | A | * | 3/1940 | Ashton | 160/352 |
| 2,512,875 | A | * | 6/1950 | Reynolds | 392/435 |
| 2,634,361 | A | * | 4/1953 | Reynolds | 392/435 |
| 2,834,071 | A | * | 5/1958 | Ernest Camerino | 52/214 |
| 2,963,019 | A | * | 12/1960 | Domsky | 126/200 |
| 3,070,085 | A | * | 12/1962 | Mills | 126/200 |
| 3,095,550 | A | * | 6/1963 | Kilduff et al. | 333/252 |
| 3,109,685 | A | * | 11/1963 | Skorupa | 312/204 |
| 3,127,890 | A | * | 4/1964 | Mills | 126/200 |
| 3,149,624 | A | * | 9/1964 | Reeves | 126/37 R |
| 3,201,296 | A | * | 8/1965 | Kilduff et al. | 156/108 |
| 3,228,388 | A | * | 1/1966 | Mills | 126/200 |
| 3,324,967 | A | * | 6/1967 | Robinson | 181/290 |
| 3,489,135 | A | * | 1/1970 | Astrella | 126/198 |
| 3,565,054 | A | * | 2/1971 | Smith et al. | 126/197 |
| 3,584,177 | A | * | 6/1971 | Bucksbaum | 219/741 |
| 3,612,825 | A | * | 10/1971 | Chase et al. | 219/405 |
| 3,659,582 | A | * | 5/1972 | Morgan | 126/198 |
| 3,664,326 | A | * | 5/1972 | Mills | 126/200 |
| 3,679,855 | A | * | 7/1972 | Binzer | 219/740 |
| 3,711,673 | A | * | 1/1973 | Takeda et al. | 219/740 |

(Continued)

FOREIGN PATENT DOCUMENTS

| | | | |
|---|---|---|---|
| CA | 2299971 | A1 * | 1/2001 |
| DE | 3412791 | | 10/1985 |

(Continued)

*Primary Examiner* — Kenneth Rinehart
*Assistant Examiner* — Jorge Pereiro

(57) ABSTRACT

A cooking appliance includes a door assembly having a main frame provided with an inner, central opening. A glass panel is secured to the main frame portion across the inner, central opening and an overlay member is adhesively secured to the glass panel through a plurality of adhesive elements. The overlay member includes top, bottom and opposing side sections that collectively define an outer, central opening. The adhesive elements establish airflow passages that extends longitudinally across the door assembly between the glass panel and the overlay member. The overlay member also includes first and second flanges that are arranged along the top and bottom edge sections respectively. Third and fourth flanges are provided on respective upper and lower edges of the outer central opening. The flanges, together with the adhesive elements, ensure the presence of the airflow passages.

10 Claims, 3 Drawing Sheets

(56) References Cited

U.S. PATENT DOCUMENTS

| | | | | | |
|---|---|---|---|---|---|
| 3,808,391 | A * | 4/1974 | Graff et al. | 219/740 |
| 3,877,460 | A * | 4/1975 | Lotz et al. | 126/200 |
| 3,894,527 | A * | 7/1975 | Ickes | 126/545 |
| 3,910,254 | A * | 10/1975 | Keimel et al. | 126/198 |
| 3,955,060 | A * | 5/1976 | Laszlo | 219/737 |
| 4,072,140 | A * | 2/1978 | Gallagher | 126/547 |
| 4,193,232 | A * | 3/1980 | Almsted et al. | 52/98 |
| 4,207,863 | A * | 6/1980 | Drouin | 126/198 |
| 4,317,481 | A * | 3/1982 | Oswald | 160/84.04 |
| 4,416,096 | A * | 11/1983 | Schuster et al. | 52/202 |
| 4,527,540 | A * | 7/1985 | Ryan et al. | 126/42 |
| 4,606,324 | A * | 8/1986 | Katona | 126/198 |
| 4,638,788 | A * | 1/1987 | Lancelot | 126/198 |
| 4,702,051 | A * | 10/1987 | Miller | 52/202 |
| 4,841,696 | A * | 6/1989 | Miller | 52/202 |
| 5,079,886 | A * | 1/1992 | Downs | 52/314 |
| 5,105,597 | A * | 4/1992 | Wilkening | 52/455 |
| 5,117,807 | A * | 6/1992 | Graulich | 126/190 |
| 5,158,638 | A * | 10/1992 | Osanami et al. | 156/245 |
| 5,235,962 | A * | 8/1993 | Doty et al. | 126/21 A |
| 5,313,035 | A * | 5/1994 | Chartrain et al. | 219/740 |
| 5,317,129 | A * | 5/1994 | Taplan et al. | 219/452.12 |
| 5,337,727 | A * | 8/1994 | Borens et al. | 126/200 |
| 5,496,104 | A * | 3/1996 | Arnold et al. | 312/204 |
| 5,545,874 | A * | 8/1996 | Hansson | 219/400 |
| 5,546,928 | A * | 8/1996 | Lewis et al. | 126/214 D |
| 5,588,421 | A | 12/1996 | Busch et al. | |
| 5,664,554 | A * | 9/1997 | Martin | 126/201 |
| 5,735,261 | A * | 4/1998 | Kieslinger | 126/190 |
| 5,782,231 | A * | 7/1998 | Wade | 126/200 |
| 5,789,724 | A * | 8/1998 | Lerssen et al. | 219/741 |
| 5,806,942 | A * | 9/1998 | Jenkins et al. | 312/204 |
| 5,928,540 | A * | 7/1999 | Antoine et al. | 219/391 |
| 5,981,927 | A * | 11/1999 | Osepchuk et al. | 219/740 |
| 6,064,041 | A * | 5/2000 | Staffieri | 219/399 |
| 6,150,609 | A * | 11/2000 | Baldwin | 174/66 |
| 6,282,825 | B1 * | 9/2001 | Godfrey et al. | 40/611.01 |
| 6,399,924 | B1 * | 6/2002 | Cai | 219/443.1 |
| 6,536,856 | B2 * | 3/2003 | Pelizzari et al. | 312/204 |
| 6,539,936 | B2 * | 4/2003 | Behn | 126/547 |
| 6,557,956 | B2 * | 5/2003 | Hightower | 312/204 |
| 6,561,180 | B1 * | 5/2003 | Austin et al. | 126/198 |
| 6,686,574 | B2 * | 2/2004 | Hyun | 219/739 |
| 6,748,943 | B1 * | 6/2004 | Krimmer | 126/547 |
| 6,796,088 | B2 * | 9/2004 | Richmond et al. | 52/36.3 |
| 6,848,441 | B2 * | 2/2005 | Bachinski et al. | 126/512 |
| 6,854,458 | B2 * | 2/2005 | Herzer | 126/198 |
| 6,910,477 | B1 * | 6/2005 | Barber | 126/91 R |
| 6,959,705 | B2 * | 11/2005 | Briedis et al. | 126/193 |
| D519,203 | S * | 4/2006 | Haas et al. | D23/405 |
| 7,053,348 | B1 * | 5/2006 | Terada et al. | 219/739 |
| 7,178,886 | B2 * | 2/2007 | Hightower | 312/265.5 |
| 7,210,475 | B2 * | 5/2007 | Barnes et al. | 126/273 R |
| 7,563,511 | B2 * | 7/2009 | Koo | 428/428 |
| 2002/0102927 | A1 * | 8/2002 | Lee et al. | 451/54 |
| 2002/0170554 | A1 * | 11/2002 | Behn | 126/547 |
| 2003/0008096 | A1 * | 1/2003 | Benitz | 428/44 |
| 2003/0201896 | A1 * | 10/2003 | Determan et al. | 340/584 |
| 2004/0011348 | A1 * | 1/2004 | Bachinski et al. | 126/193 |
| 2004/0043361 | A1 * | 3/2004 | Bialas | 434/81 |
| 2004/0164075 | A1 | 8/2004 | Henze et al. | |
| 2004/0183413 | A1 * | 9/2004 | Koo | 312/401 |
| 2004/0211405 | A1 * | 10/2004 | Briedis et al. | 126/200 |
| 2004/0226552 | A1 * | 11/2004 | Park et al. | 126/190 |
| 2005/0150485 | A1 * | 7/2005 | Barber | 126/85 R |
| 2006/0010796 | A1 * | 1/2006 | Akutsu | 52/204.5 |
| 2006/0141197 | A1 * | 6/2006 | Caparros Taracido et al. | 428/40.1 |
| 2007/0188059 | A1 * | 8/2007 | Davis et al. | 312/265.6 |
| 2008/0252186 | A1 * | 10/2008 | Crompton et al. | 312/204 |

FOREIGN PATENT DOCUMENTS

| | | | |
|---|---|---|---|
| DE | 10232609 | | 2/2003 |
| DE | 10143928 | | 5/2003 |
| EP | 754919 | A1 * | 1/1997 |
| FR | 2473610 | A * | 7/1981 |
| FR | 2834550 | | 7/2003 |
| JP | 410176834 | | 6/1998 |
| JP | 410185210 | | 7/1998 |

* cited by examiner

OVEN DOOR ASSEMBLY INCORPORATING OVERLAY MEMBER

BACKGROUND OF THE INVENTION

1. Field of the Invention

The present invention pertains to the art of cooking appliances and, more particularly, to an oven door assembly having an overlay secured to a glass panel while creating an air passage between the glass panel and the overlay.

2. Discussion of the Prior Art

In the past, kitchen appliances were made available in a limited number of colors. However, given the broad range of colors now incorporated into kitchen décor, manufactures are making appliances available in more colors. When it comes to cooking appliances, doors and, if provided, cooktops are typically the focus of attention. Cooktops are generally coated with enamel or covered with glass to provide an aesthetically pleasing finish. Doors are typically provided with an outer decorative panel that can be formed from metal or glass.

When constructing a door for an oven, heat transfer is an important consideration, particularly when the door includes a window. Accordingly, oven doors are typically formed with multiple layers that are separated by insulation and/or air gaps. The insulation and/or air gaps reduce heat transfer from the oven to outside surfaces of the door. The multiple layers are joined using a variety of manufacturing processes. For instance, the layers can be joined by mechanical fasteners, through a welding operation, or with peripheral trim pieces.

Regardless of the existence of various oven door constructions in the prior art, there still exists a need for a door assembly for a cooking appliance, that can be easily manufactured with an aesthetic appearance, yet being functionally effective to minimize excessive heat transfer of oven temperatures from reaching outer surfaces of the door assembly.

SUMMARY OF THE INVENTION

The present invention is directed to a cooking appliance in the form of an oven. The oven includes a cooking chamber having a frontal opening that is selectively closed by a door assembly. In accordance with the invention, the door assembly includes a main frame portion having top, bottom and opposing side members that collectively define an inner, central opening. A glass panel is secured to the main frame portion and extends across the inner, central opening to enable a consumer to view the contents of the cooking chamber. An overlay member is secured to the glass panel through a plurality of adhesive elements. The overlay member includes top, bottom and opposing side sections that collectively define an outer, central opening.

In accordance with the most preferred form of the invention, the adhesive elements establish at least one airflow passage that extends longitudinally across the door assembly between the glass panel and the overlay member. The airflow passage allows ambient air to pass over the glass panel, thereby reducing heat transfer from the cooking chamber to the overlay member. The overlay also includes first and second flanges arranged along the top and bottom sections respectively. Third and fourth flanges are provided on respective upper and lower edges of the outer central opening. The flanges, together with the adhesive elements, ensure adequate spacing between the glass panel and the overlay member to establish the at least one airflow passage.

Additional objects, features and advantages of the present invention will become more readily apparent from the following detailed description of a preferred embodiment when taken in conjunction with the drawings wherein like reference numerals refer to corresponding parts in the several views.

DESCRIPTION OF THE PREFERRED EMBODIMENT

Figure 1:
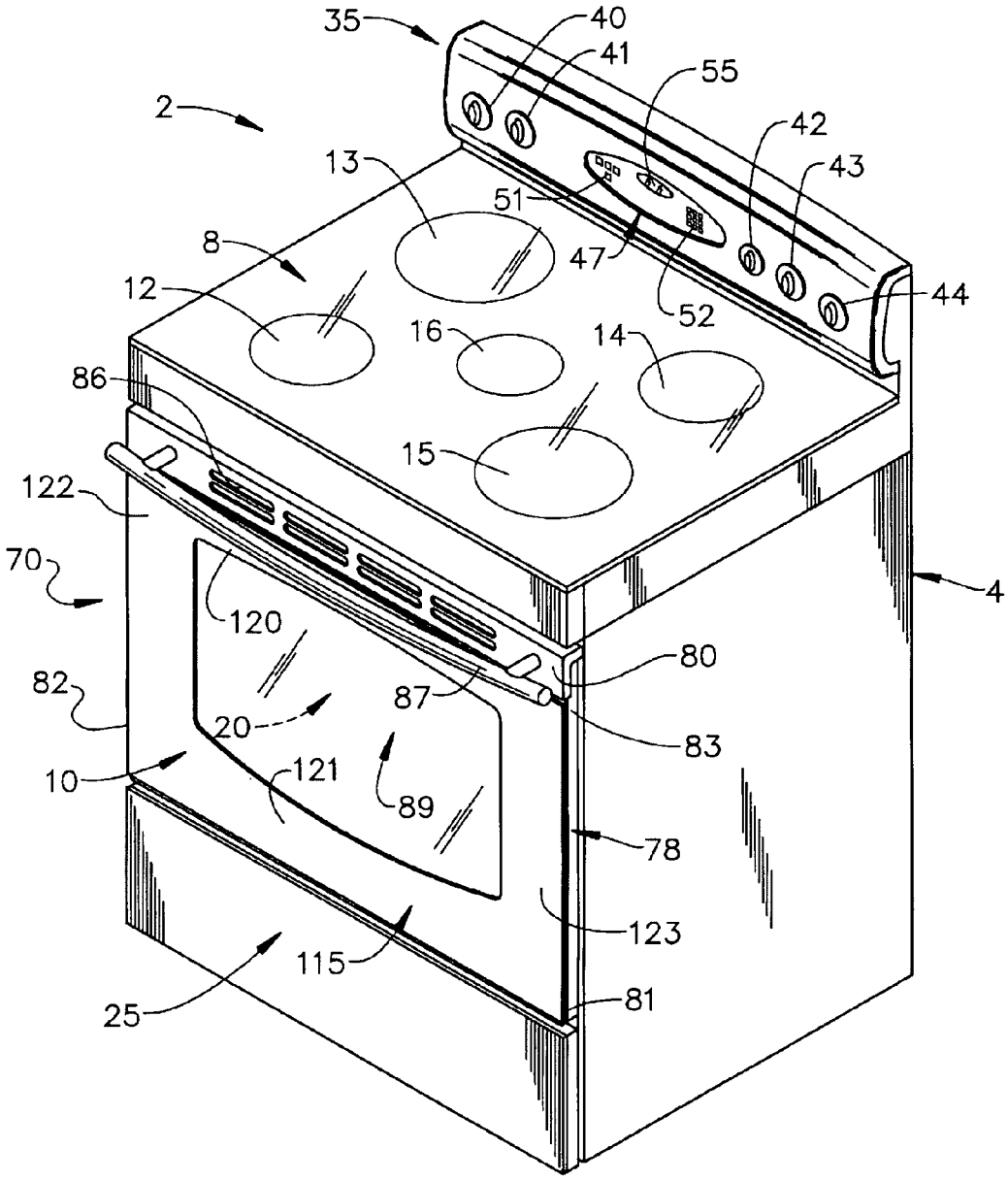
FIG. 1 is an upper right perspective view of a cooking appliance incorporating a door assembly constructed in accordance with the present invention.

With initial reference to FIG. 1, a cooking appliance constructed in accordance with the present invention is generally indicated at 2. Cooking appliance 2 is shown to include a cabinet 4 having a cooktop 8 that is provided with a plurality of cooking zones 12-16. In a manner known in the art, arranged below cooktop 8 is an oven 10 including an oven cavity or cooking chamber 20 below which is positioned a storage drawer 25. With this overall construction, cooking appliance 2 constitutes a stand-alone oven range. However, it should be understood that the present invention could be employed in various other cooking appliance models such as slide-in ranges, as well as cabinet mounted and wall mounted ovens.

Cooking appliance 2 includes a control panel 35 including a plurality of control elements 40-44 for selectively activating cooking zones 12-16 respectively. In addition, control panel 35 is provided with an oven control portion 47 having a plurality of oven control elements indicated generally at 51 and 52, as well as a display 55. The particular manner in which oven control elements 51 and 52 and display 55 are used to establish a cooking operation in cooking chamber 20 does not form part of the present invention and thus will not be discussed in detail. Instead, the present invention is particularly directed to a door assembly 70 that is pivotally mounted relative to cabinet 4 for enabling access to cooking chamber 20 for introducing or removing food items.

Figure 3:
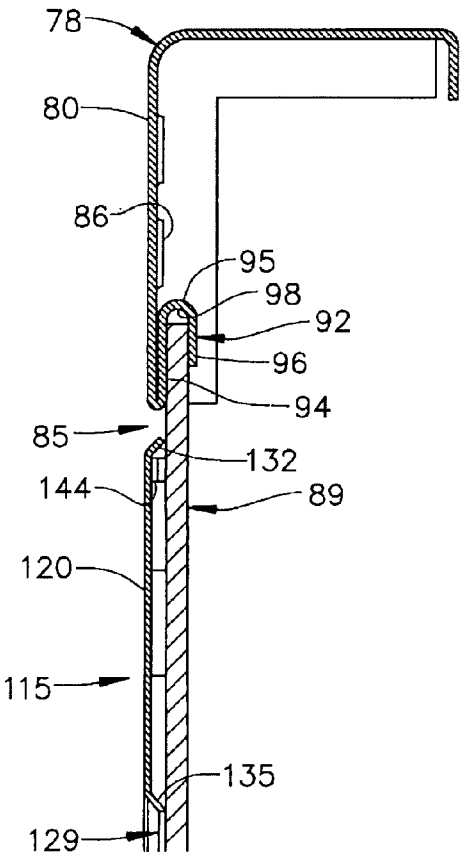
FIG. 3 is a partial, cross-sectional side view of the door assembly of FIG. 1.

As shown in FIGS. 1 and 3, door assembly 70 includes a main frame portion 78 having a top member 80, a bottom member 81 and opposing side members 82 and 83 that collectively define an inner, central opening 85. As best shown in FIG. 1, top member 80 is provided with a plurality of vents 86 that enable exhaust gases to exit cooking chamber 20, and a handle 87 that allows a consumer to pivot door assembly 70. In accordance with the invention, main frame portion 78 is covered by a glass panel 89. Actually, glass panel 89 is secured to main frame portion 78 and extends across inner, central opening 85. As best shown in FIG. 3, top member 80 includes an in-turned flange portion 92 against which glass panel 89 is positioned to secure glass panel 89 to main frame portion 78. More specifically, in-turned flange portion 92 includes a first segment 94 that folds back and extends to a curved segment 95. Curved segment 95 continues to a down-turned segment 96 so as to define a channel 98. In this manner, glass panel 89 is inserted and retained within channel 98 so as to be fixed relative to main frame portion 78. Although not shown, bottom member 81 and opposing side members 82 and 83 include corresponding flange portions for retaining glass panel 89.

Figure 2:
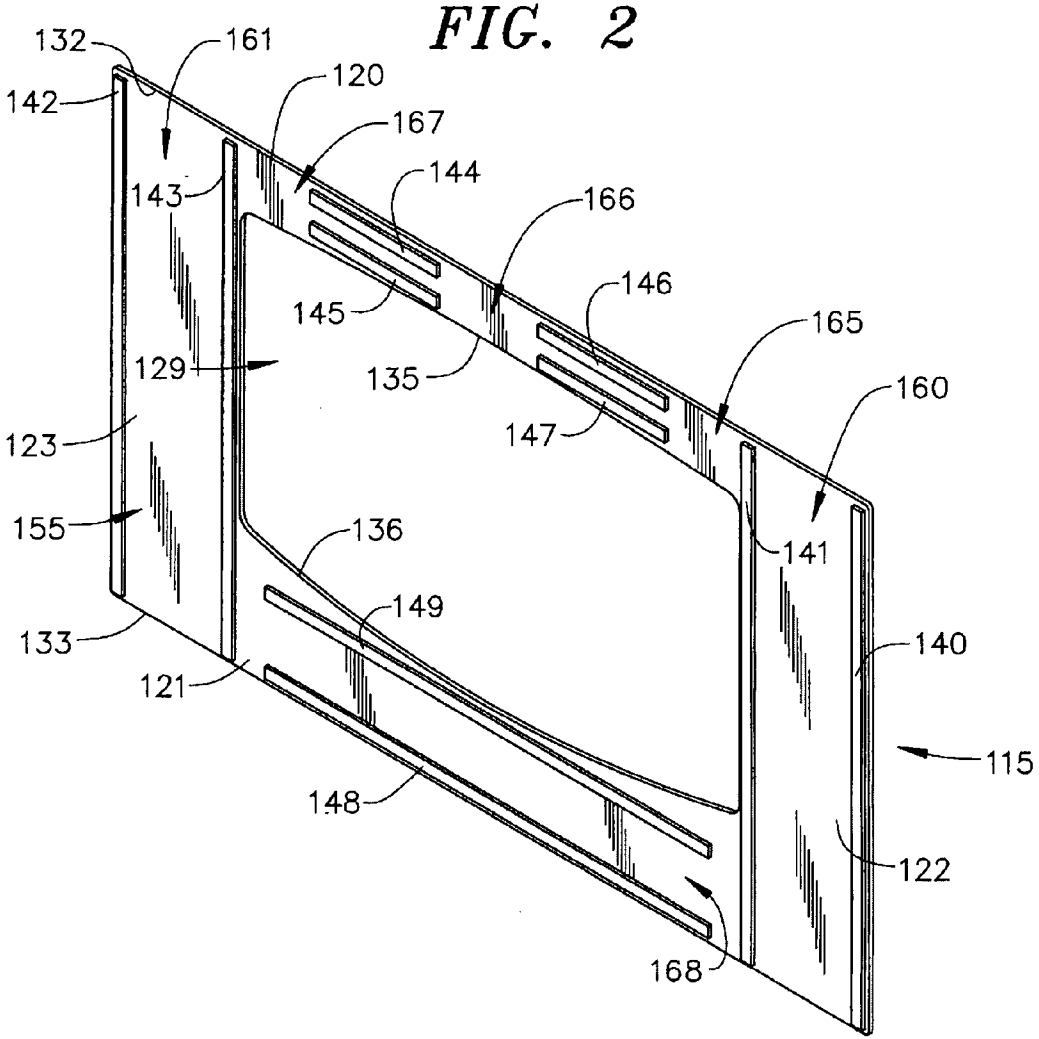
FIG. 2 is a rear perspective view of an overlay member portion of the door assembly of FIG. 1.

In accordance with the most preferred form of the present invention, an overlay member 115 is adhesively secured to glass panel 89. As best shown in FIG. 2, overlay member 115 includes a top section 120, bottom section 121 and opposing side sections 122 and 123 that collectively define an outer, central opening 129. Overlay member 115 includes first and second angled flange elements 132 and 133 that extend along top section 120 and bottom section 122 respectively (also see FIGS. 3 and 4). In addition, third and fourth angled flange elements 135 and 136 are provided on top and bottom edge sections (not separately labeled) of outer, central opening 129. First, second, third and fourth flange elements 132, 133, 135 and 136, in a manner which will be described more fully below, aid in ensuring that overlay member 115 is maintained in a desired spaced relationship from glass panel 89.

In further accordance with the most preferred form of the invention, a plurality of spaced, double-sided adhesive strips or elements 140-149 are secured to a rear portion 155 of overlay member 115. Adhesive elements 140-149 are arranged in such a manner so that, when overlay member 115 is secured to glass panel 89, adhesive elements 140-149 establish a plurality of airflow passages such as indicated at 160, 161 and 165-167. More specifically, airflow passages 160 and 161 constitute outer airflow passages while airflow passages 165-167 constitute inner airflow passages. That is, as best shown in FIG. 2, airflow passages 160 and 161 extend longitudinally along overlay member 115 on either side of outer, central opening 129. The remaining airflow passages 165-168 allow air to pass between glass panel 89 and overlay member 115 at a central portion thereof.

Figure 4:
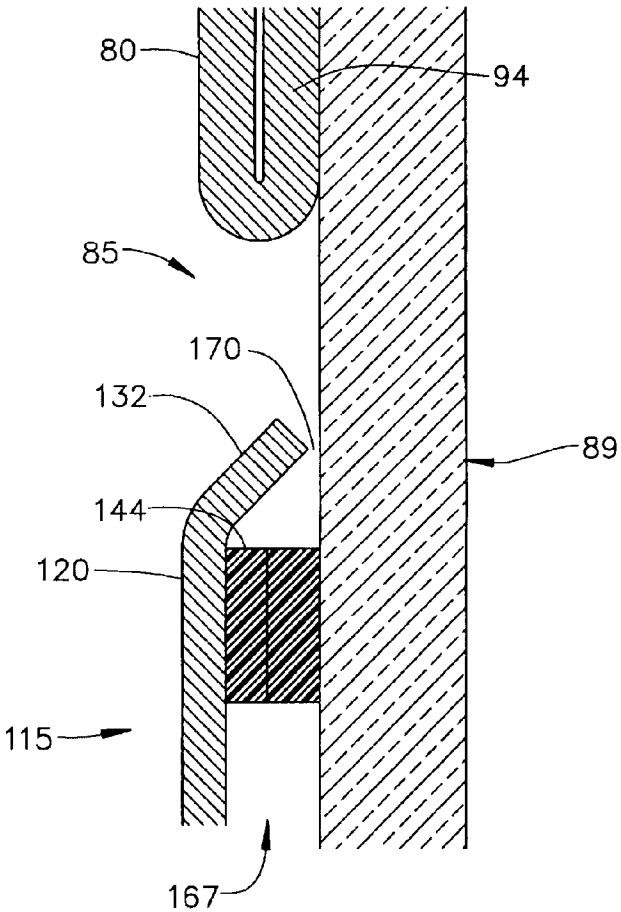
FIG. 4 is an enlarged view of an upper portion of the side view from FIG. 3.

More specifically, with reference to FIGS. 2-4, adhesive elements 144 and 146 are arranged adjacent first flange element 132 and establish gaps, such as that shown at 170 in FIG. 4, between overlay member 115 and glass panel 89 that allows the airflow to pass beneath overlay member 115 and across door assembly 70. In a similar manner, adhesive element 148 is arranged adjacent second flange element 133 to establish lower airflow passage 168. Likewise, adhesive elements 145 and 147 are positioned adjacent third flange element 135 and adhesive element 149 is positioned adjacent or generally along fourth flange element 136. In this manner, when mounted to glass panel 89, adhesive elements 140-149 and flange elements 132, 133, 135 and 136 ensure the presence of airflow passages 160, 161 and 165-168.

With the establishing of airflow passages 160, 161 and 165-168, air is permitted to flow between overlay member 115 and each of main frame portion 78 and glass panel 89. With this arrangement, the airflow will pass, at least in part, across outer, central opening 129 and provide an insulation barrier for door assembly 70. More specifically, in addition to insulation (not shown) provided in main frame portion 78, the airflow minimizes heat transfer from cooking chamber 20 to an outer surface (not labeled) of overlay member 115, while also cooling an outer surface of glass panel 89. At this point, it should be understood that the present invention provides an easy, cost effective means for constructing a door assembly for a cooking appliance. More specifically, the present invention enables a manufacturer to readily secure an outer, potentially decorative panel to an overall door assembly while, at the same time, ensuring that heat transfer from the cooking oven cavity to outer surfaces of the outer decorative panel is maintained at minimal levels.

Although described with reference to a preferred embodiment of the invention, it should be readily understood that various changes and/or modifications can be made to the invention without departing from the spirit thereof. For instance, the adhesive elements can constitute beads of epoxy, silicone or other such substance. In general, the invention is only intended to be limited by the scope of the following claims.

We claim:

1. An oven door assembly for selectively providing access to an oven cavity comprising:

a main frame portion having top, bottom and opposing side members that collectively define an inner central opening;

a glass panel secured to the main frame portion across the inner central opening;

an overlay member including top, bottom and opposing side sections that collectively define an outer central opening, said overlay member being attached to the glass panel with a majority of the inner central opening being exposed through the outer central opening; and a plurality of elements extending between the overlay member and the glass panel at spaced locations, said plurality of elements establishing a plurality of airflow passages between the glass panel and the overlay member, wherein air passing through the plurality of air passages minimizes heat transferred from the oven cavity to the overlay member, wherein the plurality elements include at least two strips and each of the at least two strips extends laterally across both the overlay member and the glass panel a distance substantially greater than a distance each of the at least two strips extends from the bottom section to the top section of the overlay member, and the plurality elements further include at least two additional strips and each of the at least two additional strips extends from the top section to the bottom section of the overlay member a distance substantially greater than a distance each of the at least two additional strips extends between the opposing side sections of the overlay member.

2. The oven door assembly according to claim 1, wherein the plurality of elements constitute a plurality of adhesive elements, with the overlay member being attached to the glass panel through the plurality of adhesive elements.

3. The oven door assembly according to claim 1, wherein the overlay member further includes first and second angled flange elements extending along the top and bottom sections respectively.

4. The oven door assembly according to claim 1, wherein the overlay member further includes an angled peripheral flange element provided along the outer central opening.

5. The oven door assembly according to claim 1, wherein the outer central opening of the overlay member extends a majority of a distance between the top and bottom sections and a majority of a distance between the opposing side sections.

6. A cooking appliance comprising:

an oven cavity;

a control portion including a plurality of control elements for selectively establishing a cooking operation in the oven cavity; and an oven door assembly for selectively providing access to the oven cavity, said oven door assembly including:

a main frame portion having top, bottom and opposing side members that collectively define an inner central opening;

a glass panel secured to the main frame portion across the inner central opening;

an overlay member including top, bottom and opposing side sections that collectively define an outer central opening, said overlay member being attached to the glass panel with a majority of the inner central opening being exposed through the outer central opening; and a plurality of elements extending between the overlay member and the glass panel at spaced locations, said plurality of elements establishing a plurality of airflow passages between the glass panel and the overlay member, wherein air passing through the plurality of air passages minimizes heat transferred from the oven cavity to the overlay member, wherein the plurality elements include at least two strips and each of the at least two strips extends laterally across both the overlay member and the glass panel a distance substantially greater than a distance each of the at least two strips extends from the bottom section to the top section of the overlay member, and the plurality elements further include at least two additional strips and each of the at least two additional strips extends from the top section to the bottom section of the overlay member a distance substantially greater than a distance each of the at least two additional strips extends between the opposing side sections of the overlay member.

7. The cooking appliance according to claim 6, wherein the plurality of elements constitute a plurality of adhesive elements, with the overlay member being attached to the glass panel through a the plurality of adhesive elements.

8. The cooking appliance according to claim 6, wherein the overlay member further includes first and second angled flange elements extending along the top and bottom sections respectively.

9. The cooking appliance according to claim 6, wherein the overlay member further includes an angled peripheral flange element provided along the outer central opening.

10. The cooking appliance according to claim 6, wherein the outer central opening of the overlay member extends a majority of a distance between the top and bottom sections and a majority of a distance between the opposing side sections.

* * * * *